US008893762B2

(12) United States Patent
Ryan et al.

(10) Patent No.: US 8,893,762 B2
(45) Date of Patent: Nov. 25, 2014

(54) EXPANDABLE PORTABLE WALL PARTITION

(71) Applicant: Versare Solutions, Inc., Minneapolis, MN (US)

(72) Inventors: Jeffrey W. Ryan, Edina, MN (US); Robert J. Jantschek, Stillwater, MN (US)

(73) Assignee: Versare Solutions, Inc., Minneapolis, MN (US)

( * ) Notice: Subject to any disclaimer, the term of this patent is extended or adjusted under 35 U.S.C. 154(b) by 0 days.

(21) Appl. No.: 13/665,129

(22) Filed: Oct. 31, 2012

(65) Prior Publication Data

US 2013/0056163 A1 Mar. 7, 2013

Related U.S. Application Data

(62) Division of application No. 12/099,579, filed on Apr. 8, 2008, now abandoned.

(51) Int. Cl.
*A47G 5/00* (2006.01)
*E04B 2/74* (2006.01)

(52) U.S. Cl.
CPC ..... *E04B 2/7425* (2013.01)
USPC ..... 160/135; 160/228

(58) Field of Classification Search
USPC ..... 160/135, 197, 202, 211, 216, 222, 226, 160/227, 206
IPC ..... E04B 2/7425
See application file for complete search history.

(56) References Cited

U.S. PATENT DOCUMENTS

| | | | | |
|---|---|---|---|---|
| 179,386 | A | 6/1876 | Yates | |
| 3,677,322 | A | 7/1972 | Brorson et al. | |
| 3,750,737 | A * | 8/1973 | Woodward | 160/206 |
| 6,009,930 | A * | 1/2000 | Jantschek | 160/135 |
| 6,068,041 | A * | 5/2000 | Miles et al. | 160/135 |
| 6,435,253 | B1 * | 8/2002 | Steeves et al. | 160/135 |
| 6,892,784 | B2 * | 5/2005 | Maas | 160/135 |
| 7,458,410 | B1 * | 12/2008 | Bronner | 160/197 |
| 2002/0117270 | A1 | 8/2002 | Steeves et al. | |
| 2003/0197165 | A1 | 10/2003 | Perelli | |

* cited by examiner

*Primary Examiner* — David Purol
(74) *Attorney, Agent, or Firm* — Gerald E. Helget; Nelson R. Capes; Briggs and Morgan, P.A.

(57) ABSTRACT

A horizontally expandable, portable wall partition is incrementally expandable between a closed position and an open position. The portable wall partition consists of a number of upright panel members that are sidewardly adjacent and vertically parallel to one another. These panel members are interconnected by connectors that allow the panels to slide past one another from the closed position to the expanded position. The partition may also have non-sliding end members that provide stability to the partition. The partition may also have nested panels.

6 Claims, 4 Drawing Sheets

EXPANDABLE PORTABLE WALL PARTITION

This application is a divisional of, and claims the benefit of priority to, U.S. patent application Ser. No. 12/099,579, filed on Apr. 8, 2008, which is incorporated herein by reference in its entirety.

BACKGROUND OF THE INVENTION

The present invention relates generally to the field of adjustable partitions. In particular, the present invention addresses a portable wall partition that can be incrementally adjusted horizontally to a desired length, without being folded into an accordion or zig-zag configuration.

Adjustable, portable partitions are known. See, e.g. U.S. Pat. Nos. 6,009,930 and 6,068,041; and U.S. Patent Publication No. 2002/0117270, all of which are hereby incorporated by reference.

Such free standing wall units are used for dividing large areas into smaller private areas. This method is relatively inexpensive and it permits the formation of areas with a wide variety of shapes, but the free standing wall units present storage and handling problems and do not allow complete flexibility in the placement of the wall units.

In particular, there is a need for an adjustable portable wall partition that can be manufactured in standard lengths but which can be expanded incrementally horizontally to a desired length. For aesthetic and other reasons, the partition must expand in substantially a single vertical plane, so that it does not form an accordion or "zig-zag" pattern. There is a further need for such an adjustable wall partition with an end member for stability. For maximum flexibility, the end member may be pivotally attached to one of the sliding members. There is also a need for such an adjustable wall partition that can be wall-mounted at one end.

SUMMARY OF THE INVENTION

A horizontally expandable, portable wall partition is incrementally expandable between a closed position and an open position. The portable wall partition consists of a number of upright panel members that are sidewardly adjacent and vertically parallel to one another. These panel members are interconnected by connectors that allow the panels to slide past one another from the closed position to the expanded position. The connectors on the top of each panel member slide independently from those on the bottom of each panel member, so that the panel members may slide past each other on an uneven surface while remaining substantially vertical. The partition may also have non-sliding end members that provide stability to the partition. The partition may also have nested panels.

A principal object and advantage of the present invention is to provide an adjustable portable partition that can be manufactured in standard lengths but which can be expanded incrementally horizontally to a desired length.

Another principal object and advantage of the present invention is that the partition can be expanded to any length between the closed position and its maximum length without taking on a zig-zag or accordion shape.

Another principal object and advantage of the present invention is that it provides one or more non-sliding end members which stabilize the partition.

Another principal object and advantage of the present invention is that the non-sliding end members may be chosen from a set of different structures in various combinations.

Another principal object and advantage of the present invention is that the sliding connectors between panel members allow the bottom panels to be slid over an uneven surface, typically by wheels, while remaining upright.

DETAILED DESCRIPTION OF THE PREFERRED EMBODIMENT

Figure 1:
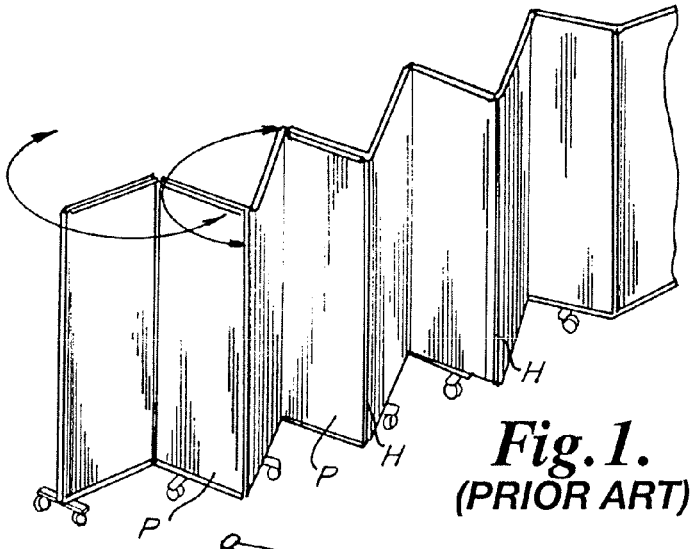
Fig. 1. (PRIOR ART)
FIG. 1 is a prior art perspective view of room dividers or wall panels commonly connected with piano hinges that fold into an accordion shape.

A typical adjustable partition of the prior art is shown in FIG. 1. As can be seen, the adjustable partition has a number of panels P connected together by hinges H. The adjustable partition can be expanded to its maximum, unfolded length as the panels P pivot on the hinges H. However, expanding the partition to any length less than its maximum length results in a part of the partition taking on a zig-zag or accordion configuration. Such a configuration is undesirable by users. Rather, users need a partition that can be incrementally expanded to any length up to its maximum length without resulting in a zig-zag or accordion configuration. Partitions in which the panels fold upon themselves inherently cannot provide the desired configuration.

The prior art partition shown in FIG. 1 also may be unstable, having a tendency to fall over, because the contact area of the panels with the floor or other surface is small relative to the height of the partition and its center of gravity.

Figure 2:
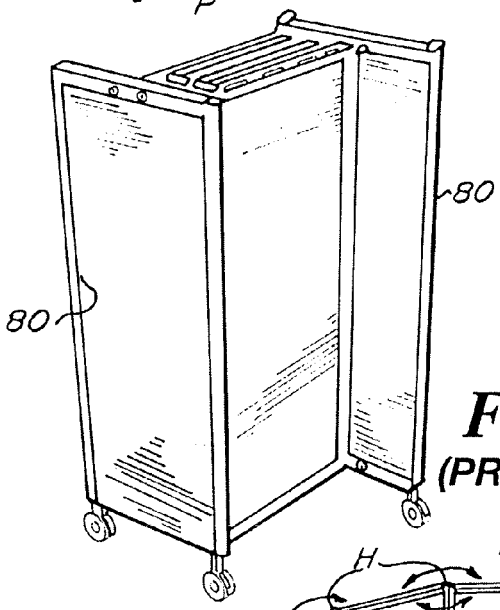
Fig. 2. (PRIOR ART)
FIG. 2 is a perspective view of a portable wall partition as shown in U.S. Pat. No. 6,009,930.
Figure 3:
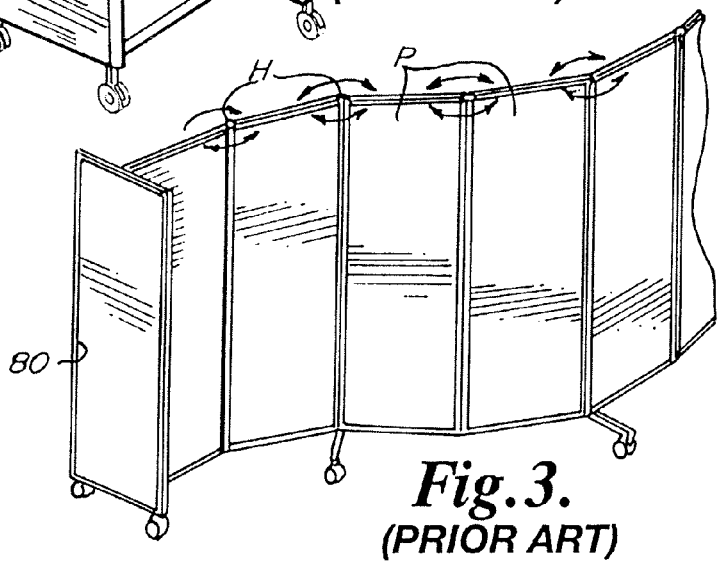
Fig. 3. (PRIOR ART)
FIG. 3 is a perspective view of a second embodiment of a portable wall partition as shown in U.S. Pat. No. 6,009,030.

U.S. Pat. No. 6,009,930, shown in FIGS. 2 and 3, shows one solution to the stability problem. A full panel end member 80 is placed at one or both ends of the partition, with the full panel end member being attached substantially perpendicularly to the outside panel or panels of the partition. The full panel end member provides increased contact with the floor or other surface and also provides bracing for the partition because the center of gravity of the full panel end member is approximately that of the partition. However, the '930 patent does not address the problem of providing a configuration in which the panels are essentially all in the same vertical plane, that is, a non-zig-zag, non-accordion configuration.

U.S. Pat. No. 6,068,041 discloses a partition in which the outside panels are slidingly mounted to an inner panel. Therefore, the '041 patent discloses an ability to provide part of a non-zig-zag, non-accordion configuration. However, because the interior panels fold on one another, the '041 patent does not solve this problem.

U.S. Pat. No. 6,435,253 discloses panels 11, 12 which slide past each other. However, the '253 patent does not fully disclose the use of non-sliding end members to provide stability.

Therefore, the present invention is addressed to solving the problems not fully addressed by the above patents.

In one embodiment (FIGS. 4-7), the present invention comprises a horizontally expandable, portable partition 10. The partition 10 comprises a plurality of upright, slidingly engaged panel members 12 provided in sidewardly adjacent and substantially vertical parallel relationship. The partition 10 also comprises a plurality of connectors 14 interconnecting the plurality of upright, slidingly engaged panel members 12 for incremental, substantially parallel movement of the upright, slidingly engaged panel members 12 from a closed position (FIG. 4) to an expanded position (FIG. 5). The partition 10 further comprises at least one non-sliding end member 16 connected to respective slidingly engaged panels 12 and providing stability to the partition 10. A second non-sliding end member 18 may also be connected to one of the plurality of upright, slidingly engaged panel members 12. Floor engaging members 20, e.g., wheels, permit the panels 12 to glide over the floor or other surface when they are moved horizontally.

Figure 4:
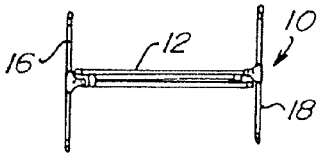
FIG. 4 is a top plan view of a first embodiment of an expandable, portable wall partition of the present invention in the closed position.
Figure 5:
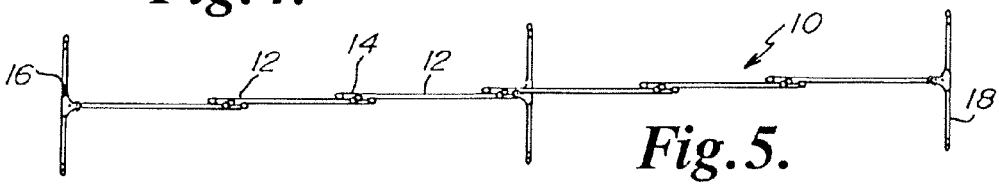
FIG. 5 is a top plan view of a first embodiment of an expandable, portable wall partition of the present invention in the expanded position.
Figure 6:
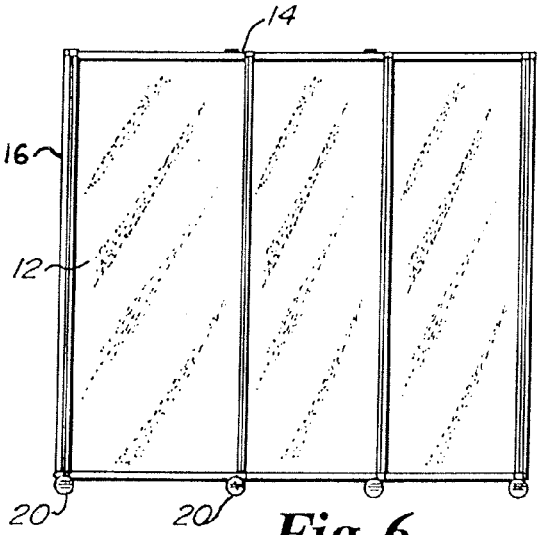
FIG. 6 is a front elevational view of the embodiment of FIG. 5.
Figure 7:
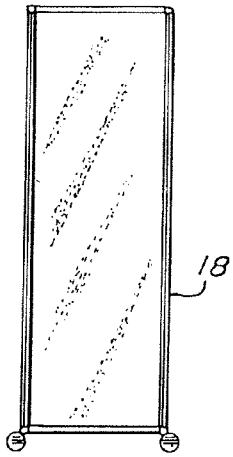
FIG. 7 is an end view of the embodiment of FIG. 6, having a full panel end member.

It will be clear from FIGS. 4 and 5 and the above description that the partition 10 can be incrementally expanded from the closed position of FIG. 4 to an expanded position represented by FIG. 5, up to the total length of the partition 10, without the need for the partition 10 to assume a zig-zag or accordion configuration.

Figure 8:
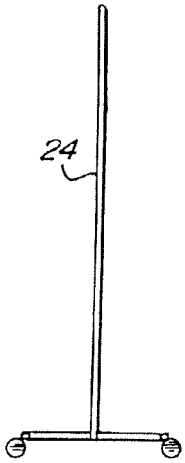
FIG. 8 is an end view of a second embodiment of an expandable, portable wall partition of the present invention having an inverted T-shaped end member.

In one embodiment (FIGS. 6 and 7), the non-sliding members 16, 18 further comprise full panel end members 20, as more fully described in U.S. Pat. No. 6,009,930, herein incorporated by reference. The full panel end members 20 provide support and rigidity to the portable partition 10 as well as privacy and noise reduction. In a second embodiment (FIG. 8), at least one of the non-sliding members 16, 18 further comprises an inverted T-shaped member 24. If a second end member 18 is needed, it may be a full panel end member 20.

Figure 9:
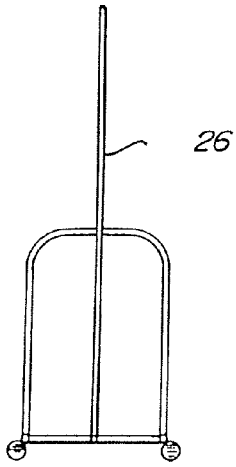
FIG. 9 is an end view of a third embodiment of an expandable, portable wall partition of the present invention having an inverted U-shaped end member.

In a third embodiment (FIG. 9) at least one of the non-sliding members 16, 18 further comprises an inverted U-shaped member 26. If a second end member 18 is needed, it may be a full panel end member 20.

In a fourth embodiment (FIG. 11), one of the non-sliding members 16, 18 may be a wall bracket 28, which may in turn allow the attachment of the partition 10 to a wall (not shown).

It will be recognized that any combination of the above-described embodiments is within the scope of this patent application. Thus, the end members 16, 18 may be two full panel end members, two inverted T-shaped members, two inverted U-shaped members, etc.

Figure 10:
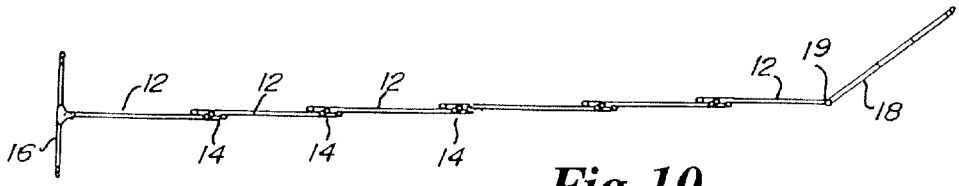
FIG. 10 is a top plan view of a fourth embodiment of an expandable, portable wall partition of the present invention having a folding panel end member.
Figure 11:
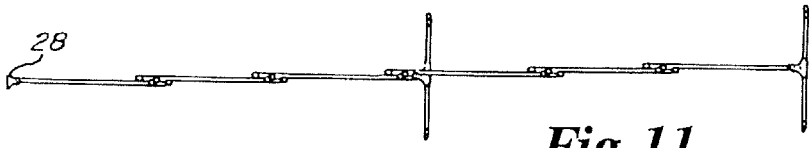
FIG. 11 is a top plan view of a fifth embodiment of an expandable, portable wall partition of the present invention having a wall mount.

A fifth embodiment is shown in FIG. 10. Here, one of the non-sliding end members 18 is pivotally connected to one of the plurality of slidingly engaged panels 12 at a pivot point 19. While FIG. 11 shows that the member 18 is a full panel end member 20, the member 18 may instead be one of an inverted T-shaped member or an inverted U-shaped member.

Figure 12A:
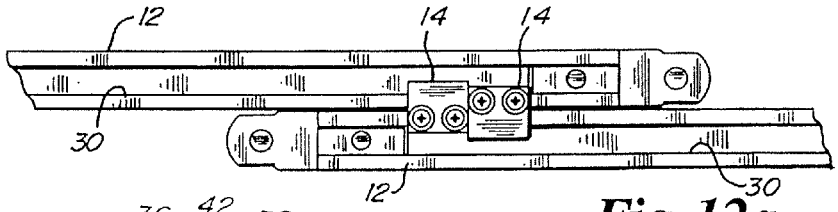
FIG. 12*a* is a top plan view of a first embodiment of a connector.
Figure 12B:
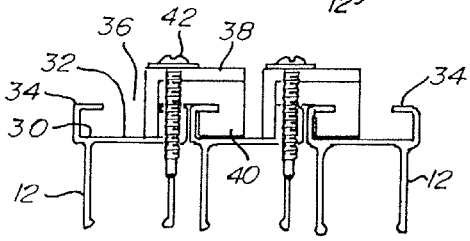
FIG. 12*b* is a cross-section taken at approximately the lines 12*b* of FIG. 12*a*.

FIGS. 12*a* and 12*b* show one embodiment of a connector 14 that interconnects the plurality of upright, slidingly engaged panel members 12. In this embodiment each of the plurality of upright, slidingly engaged panel members 12 further comprises a horizontally extending top channel 30, with the top channel 30 of adjacent slidingly engaged panel members 12 interconnected by the connectors 14. As shown in FIG. 12*b*, the horizontally extending top channels 30 are preferably U-shaped and further comprise a horizontally extending base 32 and paired, opposing, horizontally extending flanges 34. The horizontally extending flanges 34 form a slot 36 therebetween. Furthermore, each of the connectors 14 preferably comprise a substantially L-shaped first member 38 slidingly engaging the top channel 30 of one upright panel member 12 and a substantially U-shaped second member 40 slidingly engaging the top channel of an adjacent upright panel member 12, and a fastener 42 connecting the first member 38 and second member 40 to the top channel 30 of one of the upright panel members 12. The first member 38 is preferably metallic and the second member 40 is preferably non-metallic.

The partition 10 is fully opened when the connectors 14 of adjacent upright panel members 12 abut one another, thus preventing further slidable motion of the panel members 12.

Figure 13A:
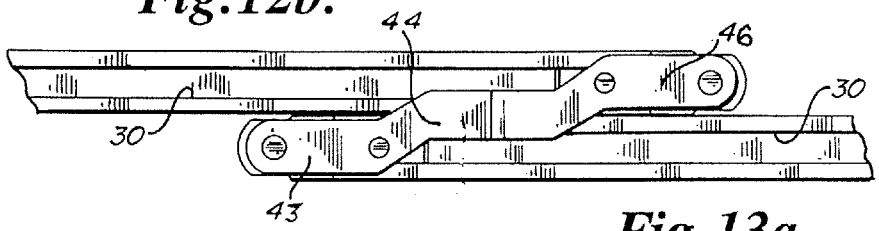
FIG. 13*a* is a top plan view of a second embodiment of a connector.
Figure 13B:
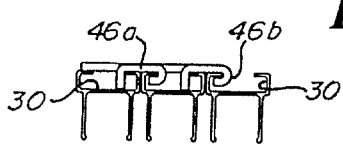
FIG. 13*b* is a cross-section taken at approximately the lines 13*b* of FIG. 13*a*.

FIGS. 13*a* and 13*b* illustrate a second embodiment of the connectors 14. Here, the connectors 14 further comprise a first portion 42 fixedly attached to one of the panels 12, a transition portion 44 extending at an angle from the first portion 42, and a third portion 46 extending at an angle from the transition portion 44. The third portion 46 slidingly engages the top channel 30 of an adjacent panel 12. The third portion 46 further comprises an L-shaped portion 46*a* and a U-shaped portion 46*b*.

The partition 10 is fully opened when the third portions 46 of adjacent upright panel members 12 abut one another, thus preventing further slidable motion of the panel members 12.

Figure 14:
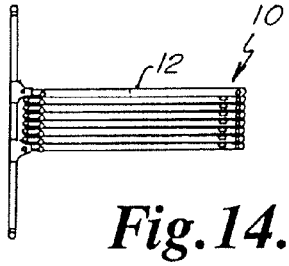
FIG. 14 is a top plan view of a sixth embodiment of an expandable, portable wall partition of the present invention in the closed position.
Figure 15:
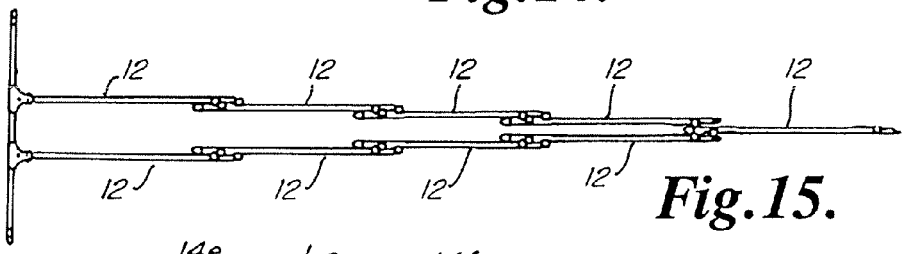
FIG. 15 is a top plan view of a sixth embodiment of an expandable, portable wall partition of the present invention in the open position.

A sixth embodiment of the partition 10 is shown in FIGS. 14 and 15. In this embodiment the upright panel members, in addition to slidingly engage each other, are also nested.

It will be understood that only the top structure of the panels has been described, but that the same or equivalent structure may be on the bottom of the panels 12.

Figure 16A:
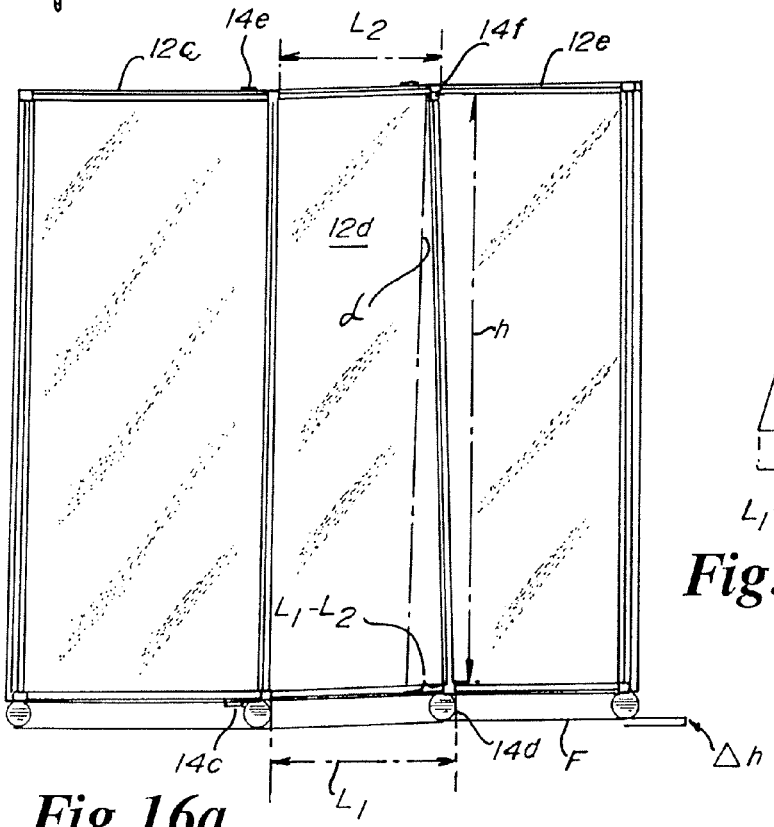
FIG. 16*a* is a front elevational view of any of the embodiments of the expandable, portable wall partition showing how the partition adjusts to variations in floor height while keeping the panel members upright.

Turning to FIG. 16*a*, a front elevational view of any of the above embodiments shows the expandable, portable partition 10 resting on an even floor surface F. Three panels 12 are shown: panels 12*c*, 12*d*, and 12*e*. It will be seen that the height of the floor surface F rises between the left panel 12*c* and the middle panel 12*d*, and then flattens out again at panel 12*f*. Because the top connectors 14*e* and 14*f* and the bottom connectors 14*g* and 14*h* move independently, the bottom connectors 14*c* and 14*d* interconnecting the middle panel 12*d* to the outer panels 12*c* and 12*e* are separated by a length $L_1$ that is greater than the separation $L_2$ between corresponding top connectors 14*e* and 14*f*. This allows the panels 12*c*, 12*d*, and 12*e* to remain upright despite the uneven floor surface.

Figure 16B:
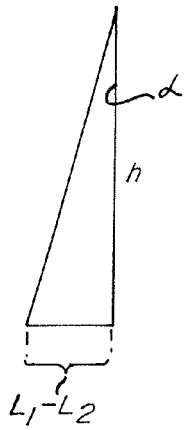
FIGS. 16*b* and 16*c* are schematics illustrating the geometry involved in calculating the maximum floor variability when the partition slides over an uneven floor surface.
Figure 16C:
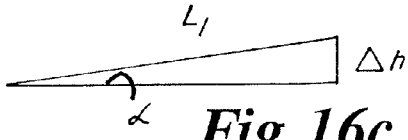

Turning to FIGS. 16*b* and 16*c*, mathematically, it can be shown that the height h of the middle panel 12*d* becomes the hypotenuse of a right triangle, and the relative difference between $L_1$ and $L_2$ can be used to determine the inclination angle α:

$$\alpha=\mathrm{Tan}^{-1}(L_1-L_2)/h$$

With the inclination angle and the extended length $L_1$, it is possible to determine the maximum floor variability Δh that the partition 10 can accommodate:

$$\Delta h=L_1 \sin \alpha.$$

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A horizontally expandable, portable wall partition incrementally expandable between a closed position and an expanded position, comprising:

(a) a plurality of upright, slidingly engaged panel members provided in sidewardly adjacent and substantially vertical parallel relationship;

(b) a plurality of connectors interconnecting the plurality of upright, slidingly engaged panel members for incremental, substantially parallel movement of the upright, slidingly engaged panel members relative to one another from the closed position to the expanded position; and (c) a non-sliding end member substantially perpendicularly connected to a slidingly engaged panel member and providing stability thereto;

(d) wherein each of the plurality of upright, slidingly engaged panel members further comprises a horizontally extending top channel, the top channels of adjacent slidingly engaged panel members being interconnected by the connectors;

(e) wherein the horizontally extending top channels are substantially U-shaped and further comprise a horizontally extending base and paired, opposing, horizontally extending flanges substantially perpendicular to the horizontally extending base and forming a slot therebetween;

(f) wherein the connectors each further comprise a substantially L-shaped first member with a vertical short leg extending down to the base of the channel of one upright panel and a horizontal long leg extending over the channel of the one upright panel and over the channel of an adjacent upright panel member and a substantially U-shaped second member below the L-shaped first member with first and second depending legs, the first leg of which extending down to the base of the channel of the one upright panel and the second leg extending down to the base of the channel and slidably capturing the flange of the adjacent upright panel, and a fastener passing through and connecting the horizontal leg of the first member and the first leg of the second member to the base of the top channel of the one upright panel member.

2. A horizontally expandable, portable wall partition according to claim 1, wherein the first member is metallic and the second member is non-metallic.

3. A horizontally expandable, portable wall partition as in claim 1, further comprising first and second non-sliding end members connected to respective slidingly engaged panel members and providing stability thereto.

4. A horizontally expandable, portable wall partition as in claim 1, wherein the non-sliding end member is a full end panel.

5. A horizontally expandable, portable wall partition as in claim 1, wherein the non-sliding end member is selected from the group consisting of: a full end panel, an inverted T-shaped member, an inverted U-shaped member, and a wall bracket.

6. A horizontally expandable, portable wall partition as in claim 1, further comprising a plurality of floor-engaging members attached to the slidingly engaged panel members and the end member.

* * * * *